US006077016A

United States Patent [19]

Geiser et al.

[11] Patent Number: 6,077,016

[45] Date of Patent: Jun. 20, 2000

[54] METHOD AND APPARATUS FOR ROUGHENING A BOOK BLOCK SPINE FORMED OF COMPRESSED PRINTED SHEETS

[75] Inventors: Peter Geiser, Matzingen; Jakob Debrunner, Frauenfeld, both of Switzerland

[73] Assignee: GRAPHA-Holding AG, Switzerland

[21] Appl. No.: 08/823,544

[22] Filed: Mar. 25, 1997

[30] Foreign Application Priority Data

Apr. 4, 1996 [CH] Switzerland ..... 0879/96

[51] Int. Cl.[7] ..... B42B 43/00

[52] U.S. Cl. ..... 412/1; 83/355; 83/876; 144/136.1; 407/35; 407/56; 412/6; 412/16

[58] Field of Search ..... 407/33, 34, 35, 407/56, 1; 83/876, 355; 412/1, 6–8, 16; 144/136.1

[56] References Cited

U.S. PATENT DOCUMENTS

| | | | |
|---|---|---|---|
| 1,642,866 | 9/1927 | Ackley . | |
| 1,980,267 | 11/1934 | Gould et al. | 412/16 |
| 2,565,583 | 8/1951 | Ackley et al. | 83/355 |
| 2,646,726 | 7/1953 | Fogg . | |
| 3,179,967 | 4/1965 | Yohn et al. | 412/16 |
| 3,747,145 | 7/1973 | Fomm et al. . | |
| 3,758,928 | 9/1973 | Blake | 407/1 |
| 3,828,409 | 8/1974 | Aspinwall | 407/61 |
| 3,980,514 | 9/1976 | Rosette et al. . | |
| 4,149,289 | 4/1979 | Sahlin | 281/21.1 |
| 4,536,012 | 8/1985 | Hume, III | 412/8 |
| 4,653,972 | 3/1987 | Lewis | 412/19 |
| 4,741,236 | 5/1988 | Averill . | |
| 4,960,295 | 10/1990 | Bodouroglou | 281/15.1 |
| 5,383,755 | 1/1995 | Hassig et al. | 412/16 |
| 5,658,111 | 8/1997 | Rathert | 412/30 |

FOREIGN PATENT DOCUMENTS

| | | |
|---|---|---|
| 27 18 296 | 11/1977 | Germany . |
| 303 678 | 12/1954 | Switzerland . |
| 676 344 | 1/1991 | Switzerland . |
| 91/06435 | 5/1991 | WIPO . |

OTHER PUBLICATIONS

Alfred Furler, "Technologie der Klebebindung, Materialien Klebstoffe Produktionsmittel", Dec. 1971, pp. 170–172.

*Primary Examiner*—Andrea L. Pitts
*Assistant Examiner*—Monica Smith Carter
*Attorney, Agent, or Firm*—Venable; George H. Spencer; Robert Kinberg

[57] ABSTRACT

An apparatus for roughening a surface of a book block spine formed of a plurality of individual printed sheets clamped together. The apparatus includes a roughening tool which has a tool bit holder having a rotary axis and a radial face; a plurality of cutter tool bits mounted in a circular array on the tool bit holder and projecting axially from the radial face and together defining a cutting plane; and a drive for rotating the tool bit holder about the rotary axis. The apparatus further includes an arrangement for effecting a relative movement between the book block spine and the roughening tool in a direction of displacement; and an arrangement for setting the roughening tool relative to the book block spine such that the cutting plane forms an acute angle with the direction of displacement, whereby arcuate markings cut simultaneously into the surface of the book block spine along diametrically opposite portions of the circular array have unlike depths.

9 Claims, 1 Drawing Sheet

METHOD AND APPARATUS FOR ROUGHENING A BOOK BLOCK SPINE FORMED OF COMPRESSED PRINTED SHEETS

This application claims the priority of Swiss Application No. 1996 0879/96 filed Apr. 4, 1996, which is incorporated herein by reference.

BACKGROUND OF THE INVENTION

This invention relates to a method and an apparatus for roughening a book block spine formed of compressed individual printed sheets by exposing the paper fibers or lifting out filler materials as the book block passes through a work station of an adhesive binder. The apparatus has a rotary roughening tool provided with tool bits penetrating into the book block spine.

In the processing of book blocks for adhesive binding, the folded printed sheets are assembled and then transferred into a clamping device of an adhesive binder in which they pass through processing stations of the adhesive binder.

The sheet folds are removed from the printed sheets, pressed into a book block spine, by a severing operation performed in the vicinity of the folds. Such a severing operation is effected, for example, in adhesive binders manufactured by the firm Muller Martini, by a circular knife rotated about a vertical axis, resulting in a relatively smooth spine surface. It has also been known to use milling tools for removing the folds. Such a spine surface, dependent upon the quality of the paper to be processed, has to be roughened in order to ensure a satisfactory bond of the upper surface of the book block spine with the adhesive utilized.

Conventionally, carbide grinding tools have been used for the subsequent roughening of the cut book block spine. As described by Alfred Furler in his book entitled "Adhesive Binding Technology" (published by Deutscher Drucker, Stuttgart, Germany), carborundum coatings are used which are mounted on a plate that rotates about a vertical axis as the book blocks are guided thereover.

It is a disadvantage of the prior art apparatus that the dust generated during the grinding operation clogs the free spaces of the Carborundum coating between the grinding core, resulting in a tendency to a breakdown of the roughening tool.

SUMMARY OF THE INVENTION

It is an object of the invention to provide an improved apparatus of the above-outlined type with which paper fibers may be exposed at the sheet edges or fillers may be lifted to optimize the surface of the book block spine which is to be bonded by an adhesive.

This object and others to become apparent as the specification progresses, are accomplished by the invention, according to which, briefly stated, the apparatus for roughening a surface of a book block spine (formed of a plurality of individual printed sheets clamped together) includes a roughening tool which has a tool bit holder having a rotary axis and a radial face; a plurality of cutter tool bits mounted in a circular array on the tool bit holder and projecting axially from the radial face and together defining a cutting plane; and a drive for rotating the tool bit holder about the rotary axis. The apparatus further includes an arrangement for effecting a relative movement between the book block spine and the roughening tool in a direction of displacement; and an arrangement for setting the roughening tool relative to the book block spine such that the cutting plane forms an acute angle with the direction of displacement, whereby arcuate markings cut simultaneously into the surface of the book block spine along diametrically opposite portions of the circular array have unlike depths.

By the method and the apparatus according to the invention as outlined above, an effective roughening of the book block spine may be achieved which is more effective than, for example, the method and apparatus disclosed in published International Application WO91/06435. It follows from the above-noted angular setting that the non-roughened spine portion of the book block and the rotary axis of the roughening tool form an angle that is greater than 90°.

Since it is a desideratum to obtain a substantially uniformly planar spine surface, the setting angle a is to be determined and maintained dependent on the diameter of the roughening tool. The sheet edges pushed laterally by the previously acting tool bits are returned into their original position by means of the subsequent deeper roughening motion and are, during this operation, slightly spread out whereby the adhesive bond to be subsequently effected is further enhanced.

According to an advantageous feature of the invention, the tool bits of the roughening tool are arranged at the circumference of a circular holder, whereby a uniform distribution of the cut markings on the book block spine may be obtained.

For the tool bits cutting elements are used which provide the desired cutting effect and ensure a gentle handling of the sheet edges as the paper fibers are exposed or the filler material is lifted.

An optimization of the upper surface of the book block spine may be achieved by selecting the circumferential speed of the working tool bits in coordination with the feeding speed of the book block such that the circular markings overlap.

DESCRIPTION OF THE PREFERRED EMBODIMENTS

Figure 1:
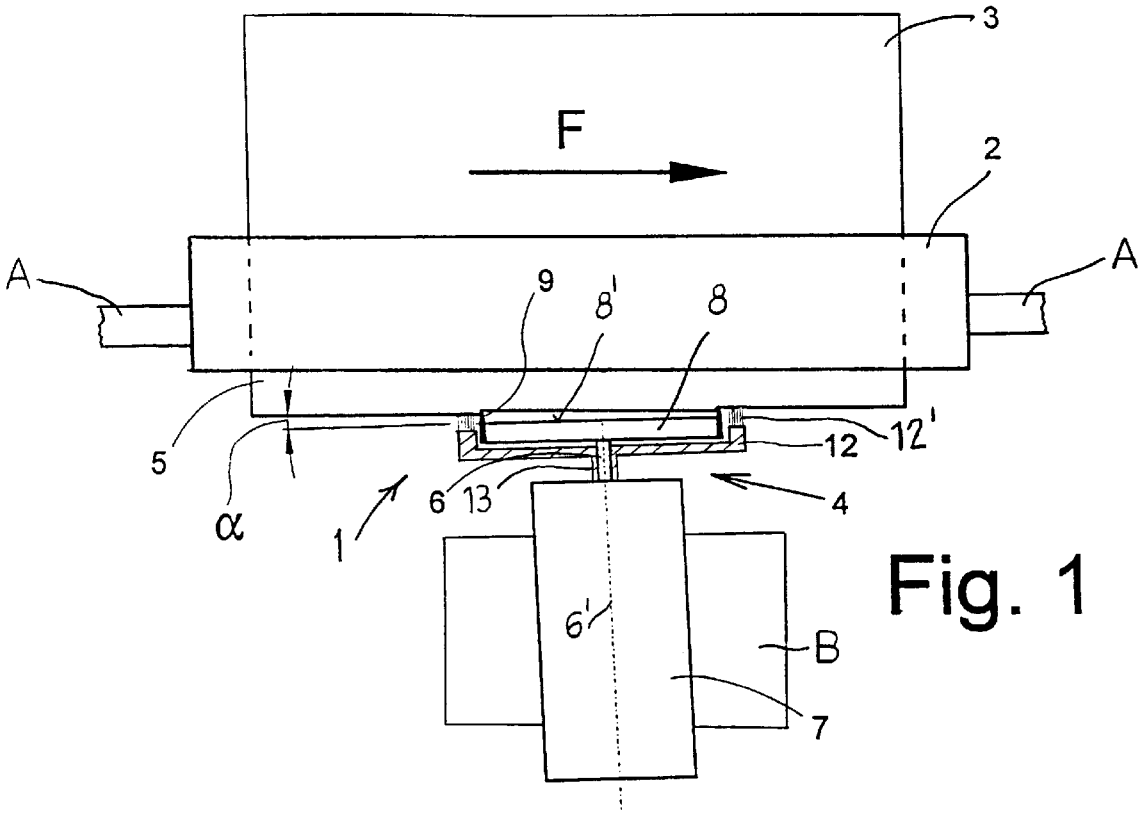
FIG. 1 is a schematic side elevational view of the apparatus according to the invention.
Figure 2:
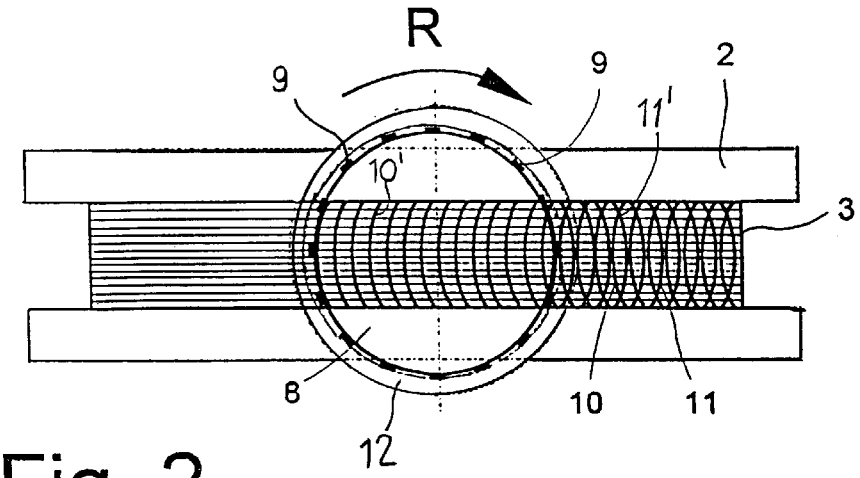
FIG. 2 is a schematic bottom plan view of the construction shown in FIG. 1, with some components omitted for clarity.

FIGS. 1 and 2 illustrate an apparatus 1 for roughening a book block spine of a book block 3 clamped in a clamping mechanism 2 of a non-illustrated adhesive binding apparatus. The book block is conveyed together with the clamping mechanism 2 in the direction of the arrow F as it passes by a roughening tool 4 of a processing station of the adhesive binder. The conventional moving mechanism is designated symbolically at A.

In a non-illustrated processing station situated upstream of the roughening tool 4 (as viewed in the direction F), the folds of the printed sheets have been removed from the book block (formed of clamped individual printed sheets) at the overhanging edge portion 5 by a severing or a milling operation.

For optimizing the adhesive bond to be subsequently provided, in the roughening station the surface of the book block spines is roughened by exposing the paper fibers at the sheet edges of the printed sheets or by lifting binder material from the sheet edges.

The roughening tool 4 coupled with the drive shaft 6 of a motor 7 has a holder disk 8. Tool bits (cutter edges) 9 are secured in a circular array along the periphery of the holder disk 8 and project axially from its radial end face 8' which is oriented towards the book block spine. The cutting tool bits 9 may be fastened to the radial face 8' of the holder disk 8. The roughening tool 4 may be rotated in either direction about the rotary axis 6'; FIG. 2 shows a clockwise rotation as indicated by the arrow R.

The cutting tool 4 is so positioned, for example, by securement to a base B that the projecting tool bits 9 are arranged in a cutting plane which forms an acute setting angle $\alpha$ with the working plane on the book block spine (that is, with the direction F), so that the circular cuts in the spine made by the roughening tool 4 which projects laterally beyond both sides of the spine will have different depths. Such two opposite arcuate cuts of a single circular cutting pass are designated at 10' and 11' in FIG. 2. Stated differently, oppositely located arcuate cuts 10', 11' which were made with one and the same cutting pass with the cutting tool 4 along diametrically opposite portions of the circle on which the bits 9 are positioned, have a greater depth in the leading part of the spine than in the trailing part, as viewed in the conveying direction F. Therefore, in this operation, the angle which lies in the plane formed by the rotary axis 6' of the roughening tool 4 and the conveying direction F, and which is formed by the length dimension of the non-roughened spine and the rotary axis of the roughening tool, is greater than 90°. The working depth of the roughening tool 4 is maximum 1 mm.

By coordinating the circumferential speed and/or the number of tool bits 9 with the conveying speed of the book block effected by the moving mechanism A, the closeness (density) of the cuts (markings) on the spine may be arbitrarily selected.

FIGS. 1 and 2 further show a combination of the roughening tool 4 with an annular brush 12 surrounding the holder 8 and being concentric therewith. The annular brush 12 has a shaft 13 connected to the drive of the roughening tool 4. The purpose of the annular brush 12 is to remove dust and fragments from the roughened spine surface. The free-standing bristles 12' of the annular brush 12 which may be rotated codirectionally with or in opposite direction to the rotation of the roughening tool 4 are sufficiently long in the axial direction to reach to the bottom of the circularly arcuate cuts (four of which are designated at 10, 10', 11 and 11').

It will be understood that the above description of the present invention is susceptible to various modifications, changes and adaptations, and the same are intended to be comprehended within the meaning and range of equivalents of the appended claims.

What is claimed is:

1. A method of roughening a surface of a book block spine formed of a plurality of individual printed sheets clamped together, comprising the following steps:

(a) effecting a relative movement between the book block spine and a circular roughening tool parallel to a length dimension of the book block spine; said roughening tool having a plurality of cutting tool bits, said plurality of cutting tool bits together defining a cutting plane;

(b) rotating said roughening tool about a rotary axis; and (c) positioning said roughening tool such that (1) said cutting plane defined by said plurality of cutting tool bits is oriented face-to-face with said surface of said book block spine;

(2) said rotary axis forms an angle of more than 90° with a vector starting at a point of intersection between the surface of the book block spine and said rotary axis and in a direction opposite the direction of said relative movement between the roughening tool and the book block spine, as observed from the roughening tool, said cutting plane thus forming an acute angle with said surface of said book block spine;

(3) said cutting tool projects bilaterally beyond said book block spine; and (4) said tool bits are thus caused to penetrate into said surface simultaneously along a first circularly arcuate portion of said cutting tool and a second circularly arcuate portion of said cutting tool; said first and second arcuate portions being diametrically opposite one another relative to said rotary axis, whereby arcuate markings cut into said surface of said book block spine along said first circularly arcuate portion of said cutting tool have a depth different from arcuate markings cut into said surface of said book block spine along said second circularly arcuate portion of said cutting tool.

2. The method as defined in claim 1, wherein step (a) comprises the step of moving said book block spine in a conveying direction parallel to the surface of said book block spine.

3. The method as defined in claim 2, wherein said acute angle is formed between said cutting plane and said conveying direction.

4. The method as defined in claim 2, wherein step (c) comprises the step of positioning said cutting tool such that a not-yet-roughened surface of said book block spine forms an angle greater than 90° with said rotary axis.

5. The method as defined in claim 1, further comprising the step of coordinating an rpm of the rotation performed in step (b) with a relative speed of the motion performed in step (a) such that the cut markings intersect.

6. A method according to claim 1, wherein each cutting edge extends the same amount from an axial face of said roughening tool, thus defining said cutting plane.

7. A method of roughening a book block spine formed from individual compressed printed sheets of paper by exposing the paper fibers and removing the filler materials when passing by a processing station of an adhesive binder, the method comprising the steps of:

providing a roughening tool having processing edges that enter the book block spine, which processing edges are arranged on a radial face around the circumference of the roughening tool, projecting from said radial face, and which processing edges form a cutting plane, said cutting plane being parallel to the plane of said radial face, said roughening tool being capable of being rotated about a rotational axis;

positioning said roughening tool such that said rotational axis forms an angle of more than 90° with a vector starting at a point of intersection between the plane of the book block spine and said rotational axis and in a direction opposite a direction of relative movement between the roughening tool and the book block spine, as observed from the roughening tool, the relative movement being in a lengthwise direction along the book block spine, said cutting plane thus forming an acute angle with the plane of the book block spine, resulting in a first end of said cutting plane being inclined toward the plane of the book block spine and a second end of said cutting plane being inclined away from the plane of the book block spine;

rotating said roughening tool around said rotational axis;

effecting said relative movement between the book block spine and said roughening tool, said movement being in said lengthwise direction of the book block spine, and during which movement the processing edges of the roughening tool cause circular-segment-type markings in the book block spine, those markings being caused by said first end of the roughening tool being deeper than those markings being caused by said second end of the roughening tool.

8. A method according to claim 6, wherein the markings corresponding to circular segments that are preceding in the direction of said relative movement and the markings corresponding to circular segments that are succeeding in the direction of said relative movement overlap each other.

9. A method according to claim 6, wherein each cutting tool bit extends the same amount from an axial face of said roughening tool, thus defining said cutting plane.

* * * * *